US008660462B2

(12) United States Patent
Ohba et al.

(10) Patent No.: US 8,660,462 B2
(45) Date of Patent: Feb. 25, 2014

(54) IMAGE FORMING APPARATUS WITH REPLACEABLE MEMBER

(75) Inventors: Shinichi Ohba, Kanagawa (JP); Akihito Yamauchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 149 days.

(21) Appl. No.: 13/273,794

(22) Filed: Oct. 14, 2011

(65) Prior Publication Data

US 2012/0243902 A1 Sep. 27, 2012

(30) Foreign Application Priority Data

Mar. 25, 2011 (JP) ..... 2011-067814

(51) Int. Cl.
*G03G 15/00* (2006.01)
*G03G 21/18* (2006.01)

(52) U.S. Cl.
USPC ..... 399/116; 399/110

(58) Field of Classification Search
USPC ..... 399/110, 111, 112, 116
See application file for complete search history.

(56) References Cited

U.S. PATENT DOCUMENTS 5,734,949 A 3/1998 Goto et al.
5,745,823 A 4/1998 Goto et al.
6,016,412 A 1/2000 Goto et al.
7,756,441 B2 7/2010 Kanno et al.
2007/0160386 A1* 7/2007 Kawamura ..... 399/110
2008/0138105 A1 6/2008 Kanno et al.
2008/0138106 A1 6/2008 Kanno et al.
2009/0028601 A1 1/2009 Mizuno et al.
2009/0116869 A1 5/2009 Kotsuka et al.
2010/0158565 A1 6/2010 Kanno et al.
2011/0076055 A1* 3/2011 Lee et al. ..... 399/110
2011/0123225 A1 5/2011 Kanno et al.
2011/0129251 A1 6/2011 Kanno et al.

FOREIGN PATENT DOCUMENTS

JP A-05-303242 11/1993
JP A-07-302007 11/1995
JP A-2008-165189 7/2008
JP A-2008-310292 12/2008
JP A-2009-116315 5/2009

* cited by examiner

*Primary Examiner* — Sophia S Chen
(74) *Attorney, Agent, or Firm* — Oliff PLC

(57) ABSTRACT

An image forming apparatus includes an apparatus body including a positioning portion, a replaceable member that is provided so as to be attachable to and detachable from the apparatus body, and has a portion to be positioned that comes into contact with and is positioned by the positioning portion at least at one longitudinal end, and an urging mechanism that urges the portion to be positioned toward the positioning portion, wherein when the position of the replaceable member in a longitudinal direction is determined, the replaceable member is mounted on the apparatus body as the urging mechanism is switched from the state where the urging force of the urging mechanism does not act to the state where the urging force of the urging mechanism acts so that the positioning portion and the portion to be positioned come into contact with each other.

14 Claims, 16 Drawing Sheets

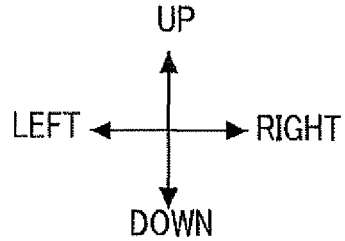
FIG. 6A
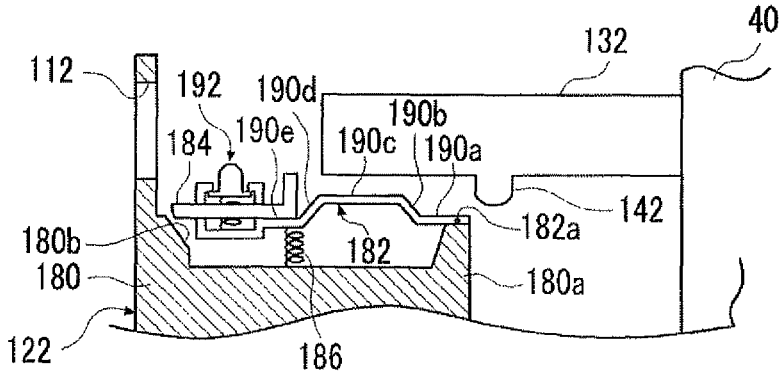
FIG. 6B
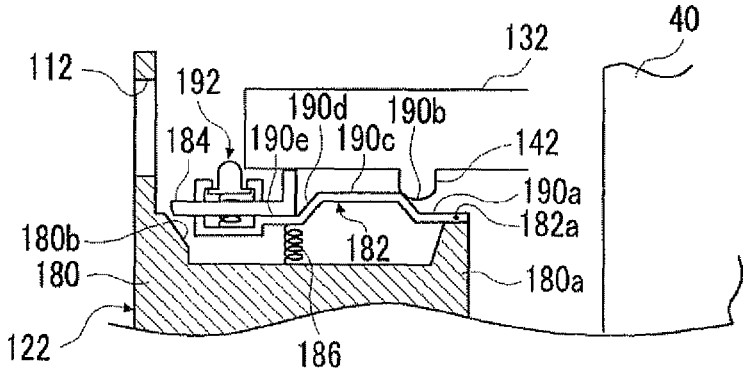

IMAGE FORMING APPARATUS WITH REPLACEABLE MEMBER

CROSS-REFERENCE TO RELATED APPLICATIONS

This application is based on and claims priority under 35 USC 119 from Japanese Patent Application No. 2011-067814 filed Mar. 25, 2011.

BACKGROUND

Technical Field

The present invention relates to an image forming apparatus.

SUMMARY

According to an aspect of the invention, there is provided an image forming apparatus including an apparatus body including a positioning portion; a replaceable member that is provided so as to be attachable to and detachable from the apparatus body, and has a portion to be positioned that comes into contact with and is positioned by the positioning portion at least at one longitudinal end; and an urging mechanism that urges the portion to be positioned toward the positioning portion, wherein the urging mechanism is switched between a state where an urging force acts on the portion to be positioned and a state where an urging force does not act on the portion to be positioned, and wherein, when the position of the replaceable member in a longitudinal direction is determined, the replaceable member is mounted on the apparatus body as the urging mechanism is switched from the state where the urging force of the urging mechanism does not act to the state where the urging force of the urging mechanism acts so that the positioning portion and the portion to be positioned come into contact with each other.

BRIEF DESCRIPTION OF THE DRAWINGS

Exemplary embodiments of the present invention will be described in detail based on the following figures, wherein:

FIGS. 6A to 6D are explanatory views illustrating an interlocking mechanism to which one exemplary embodiment of the invention is applied, and its operation;

DETAILED DESCRIPTION

First Exemplary Embodiment

Exemplary embodiments of the invention will be described with reference to the accompanying drawings.

Figure 1:
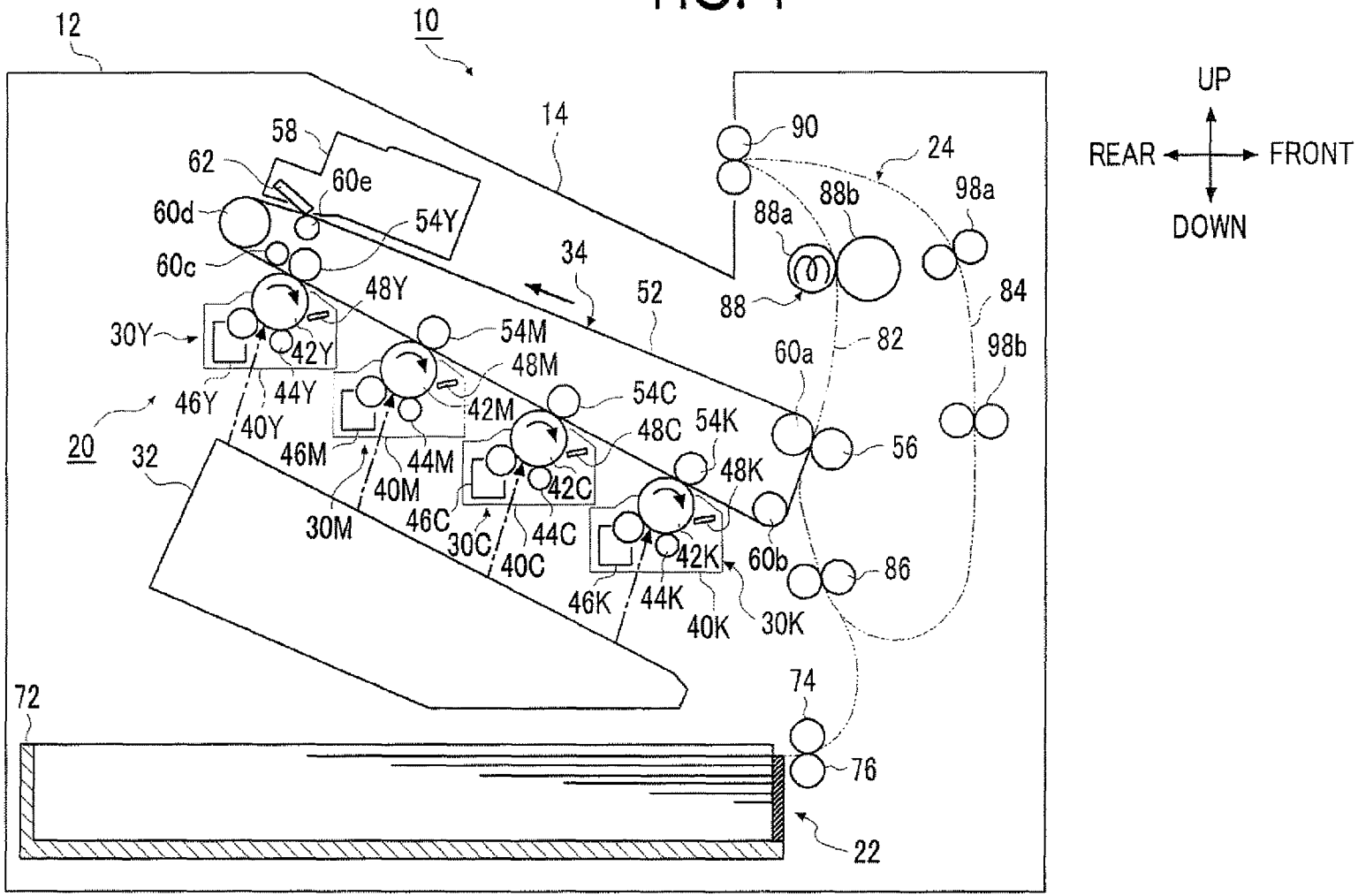
FIG. 1 is a cross-sectional view showing an image forming apparatus to which one exemplary embodiment of the invention is applied.

FIG. 1 is a cross-sectional view of an image forming apparatus 10 as one exemplary embodiment of the invention.

The image forming apparatus 10 has an image forming apparatus body 12. The upper face of the image forming apparatus body 12 is used as a discharge part 14 to which a recording medium on which an image is formed is discharged.

An image forming section 20 that forms an image to be transferred to a recording medium, a recording medium supply device 22 that supplies a recording medium to the image forming section 20, and a transporting path 24 along which the recording medium supplied from this recording medium supply device 22 is transported to the discharge part 14 are disposed within the image forming apparatus body 12.

The image forming section 20 is constituted by, for example, image forming members 30Y, 30M, 30C, and 30K corresponding to four colors of yellow (Y), magenta (M), cyan (C), and black (K), an optical writing device 32, and a transfer device 34.

The image forming members 30Y, 30M, 30C, and 30K and their constituent elements are similarly constituted except for the colors of images to be formed. Hereinafter, Y, M, C, and K may be omitted as to configurations corresponding to the respective colors, and may be collectively described as the "image forming member 30".

Each image forming member 30 is used as a replaceable member and is provided so as to be attachable to and detachable from the image forming apparatus body 12. The image forming members 30 are arranged in order of the image forming members 30Y, 30M, 30C, and 30K sequentially from the rear side (left side in FIG. 1) of the image forming apparatus body 12.

The image forming members 30 adopt, for example, an electrophotography method that forms a color image.

The image forming members 30 include an image forming member body 40, respectively. A drum-shaped photoreceptor 42 as an image carrier of carrying a developer image, a charging device 44 as a charging unit including a charging roll that uniformly charges the photoreceptor 42, a developer unit 46 that develops a latent image written into the photoreceptor 42 with a developer (toner), and a cleaner device 48 that scrapes off, for example, and cleans a waste developer that remains on the photoreceptor 42 are provided within the image forming member body 40.

The developer units 46 develop latent images formed on the corresponding photoreceptors 42, using stored Y, M, C, and K developers, respectively.

The optical writing device 32 is used as a latent image forming device, and irradiates the photoreceptors 42 with light, respectively, to form latent images on the respective surfaces of the photoreceptors 42.

The transfer device 34 has an intermediate transfer body 52 used as a transfer body, first transfer rolls 54Y, 54M, 54C, and 54K used as first transfer devices, a second transfer roll 56 used as a second transfer device, and a cleaner device 58.

The intermediate transfer body 52 has, for example, an endless belt shape, and is supported by five backup rolls 60*a*, 60*b*, 60*c*, 60*d*, and 60*e* so as to be rotatable in the direction indicated by the arrow in FIG. 1. At least one of the backup rolls 60*a*, 60*b*, 60*c*, 60*d*, and 60*e* is coupled to a drive part (not shown), such as a motor, and is rotated under the driving transmission from this drive part, whereby the intermediate transfer body 52 is rotated.

The backup roll 60*a* is arranged so as to face the second transfer roll 56, and functions as a back-up roll of the second transfer roll 56. The portion pinched by the second transfer roll 56 and the backup roll 60*a* becomes a second transfer position.

The first transfer rolls 54 transfer developer images formed on the surfaces of the photoreceptors 42 by the corresponding developer units 46 to the intermediate transfer body 52.

The second transfer roll 56 transfers the Y, M, C, and K developer images transferred to the intermediate transfer body 52 to a recording medium.

The cleaner device 58 has a scraping-off member 62 that scrapes off the respective color developers remaining on the surface of the intermediate transfer body 52 after the respective color developer images are transferred to a recording medium by the second transfer roll 56. The developers that are scraped off by the scraping-off member 62 are recovered within the main body of the cleaner device 58.

The recording medium supply device 22 has a recording medium storage container 72 that stores recording medium in a stacked state, a feed roll 74 that takes out a top recording media stored in the recording medium storage container 72 and transports the taken-out recording medium toward the image forming section 20, and a retard roll 76 that separates the recording media, and prevents plural recording media from being transported to the image forming section 20 in an overlapped state.

The transporting path 24 is constituted by a main transporting path 82 and a reversal transporting path 84.

The main transporting path 82 transports a recording medium supplied from the recording medium supply device 22 to the image forming section 20, and discharges the recording medium on which an image is formed in the discharge part 14.

The feed roll 74, the retard roll 76, a registration roll 86, the transfer device 34, a fixing device 88, and a discharge roll 90 are arranged in the main transporting path 82 sequentially from the upstream side in the recording-medium transport direction.

The registration roll 86 temporarily stops the leading edge of a recording medium transported from the recording medium supply device 22 side, and delivers the recording medium toward the transfer device 34 as to match the timing when an image is formed.

The fixing device 88 has a heating roll 88*a* and a pressure roll 88*b*, and heats and presses the recording medium that passes through between the heating rolls 88*a* and the pressure roll 88*b*, to fix a developer image onto the recording medium.

The discharge roll 90 discharges a recording medium, on which a developer is fixed by the fixing device 88, to the discharge part 14.

The reversal transporting path 84 is a transporting path along which a recording medium having a developer image formed on one side thereof is supplied again toward the image forming section 20 while being reversed. For example, two reversal transport rolls 98*a* and 98*b* are arranged at the reversal transporting path 84.

A recording medium is transported to the discharge roll 90 from the main transporting path 82, and the recording medium is supplied to the reversal transporting path 84 as the discharge roll 90 rotates reversely in a state where the trailing edge of the recording medium is pinched by the discharge roll 90. The recording medium supplied to the reversal transporting path 84 is transported to a position upstream of the registration roll 86 by the reversal transport rolls 98*a* and 98*b*.

Next, the peripheral structure of a part where the image forming member 30 is mounted will be described.

Figure 2:
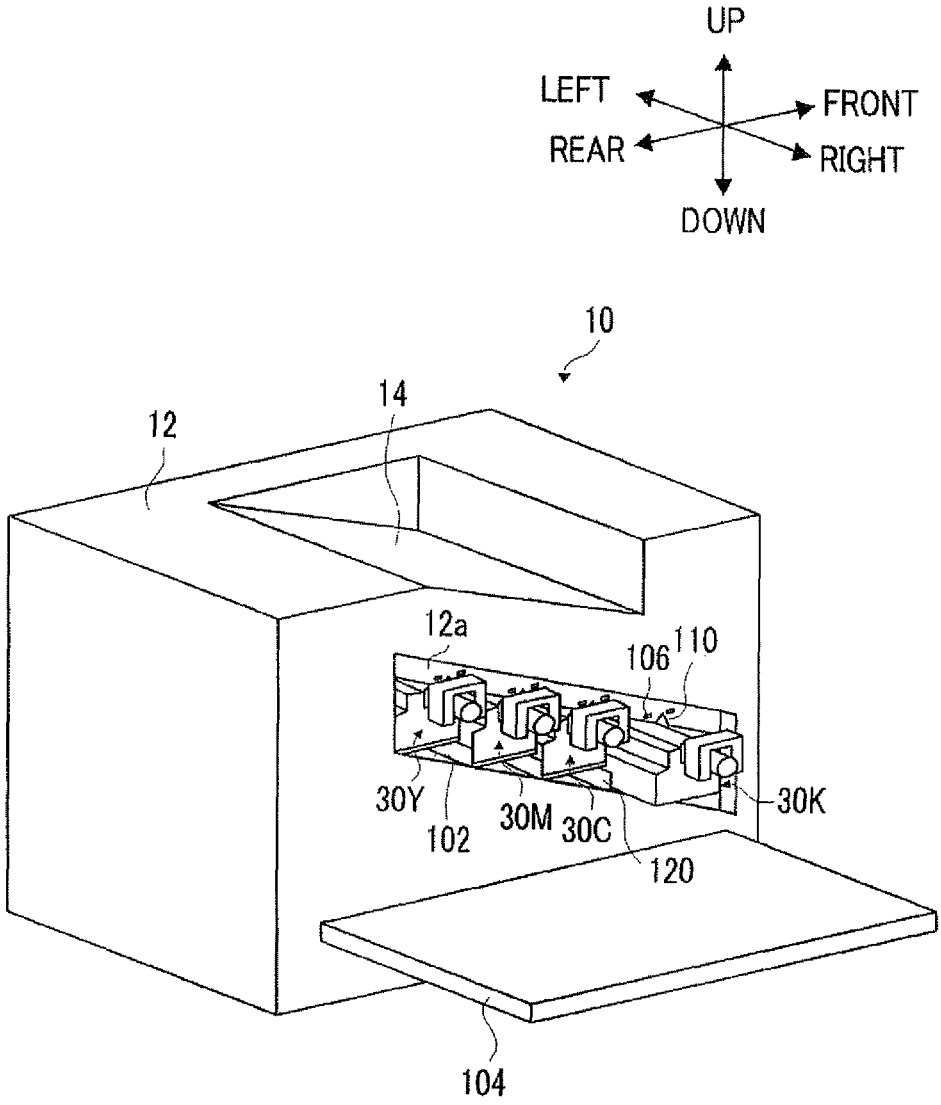
FIG. 2 is a perspective view of the image forming apparatus to which one exemplary embodiment of the invention is applied.

FIG. 2 is a perspective view of the image forming apparatus 10.

Figure 3:
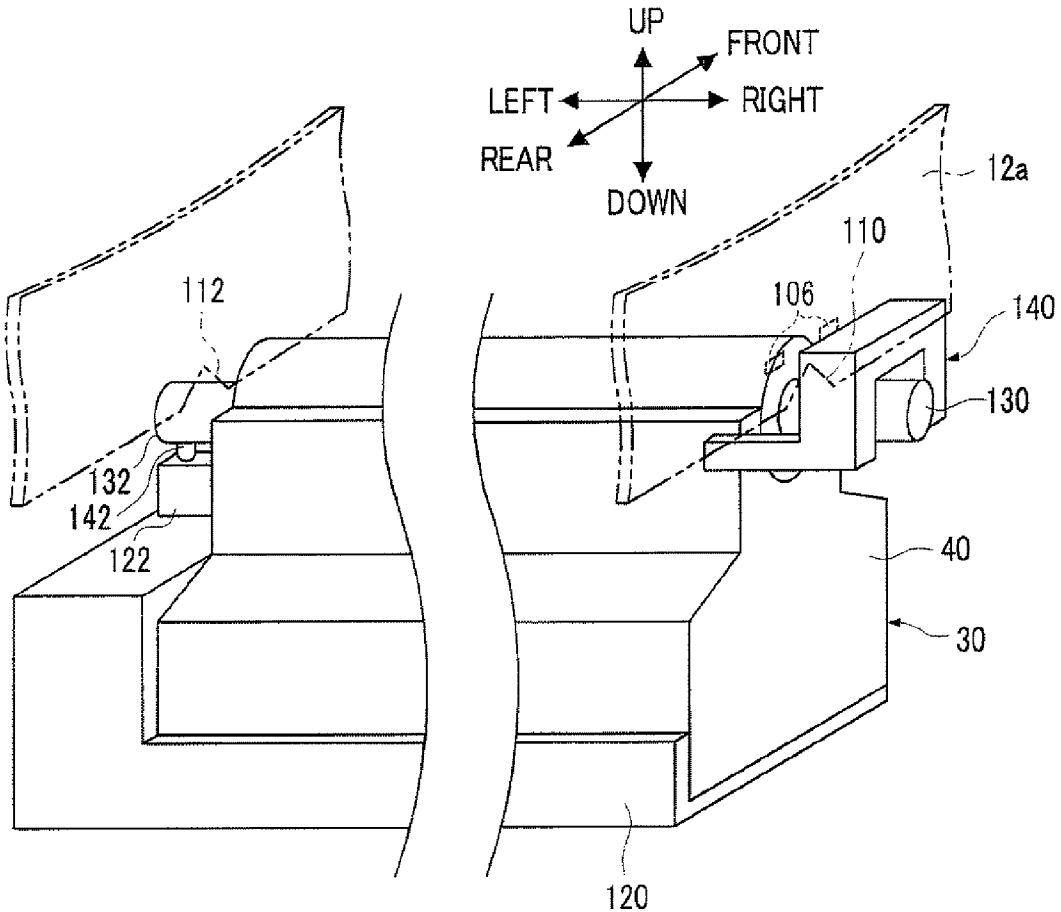
FIG. 3 is a perspective view of a state where an image forming member is mounted on an image forming apparatus body to which one exemplary embodiment of the invention is applied, and its peripheral structure.

FIG. 3 is a perspective view of a state where an image forming member 30 is mounted on the image forming apparatus body 12, and its peripheral structure.

In the present exemplary embodiment, the image forming member 30 is inserted toward left side from the right side of the image forming apparatus body 12.

The image forming apparatus body 12 is provided with an opening 102 that allows the image forming member 30 to be attached and detached therethrough, and an opening/closing portion 104 that are openably and closably provided at the image forming apparatus body 12 to open and close the opening 102.

The opening 102 is used as an insertion portion, and the image forming member 30 is mounted so as to be inserted into the image forming apparatus body 12 from the opening 102.

A hooked portion 106, in which a hooking portion 162 that will be described below is hooked, is formed in a wall portion 12*a* above the opening 102.

The opening 102 is formed with a first positioning portion 110 that comes into contact with one end of the image forming member 30 and determines the position of the image forming member. The first positioning portion 110 is formed as, for example, a cut-out that is obtained cutting out a sheet metal that constitutes the image forming apparatus body 12 in the shape of the letter V.

A second positioning portion 112 that comes into contact with the other end of the image forming member 30 and determines the position of the image forming member is formed on a side (an inner side in an insertion direction) opposite to a side (a near side in the insertion direction) where the opening 102 of the image forming apparatus body 12 is formed. Similarly, the second positioning portion 112 is formed as, for example, a cut-out that is obtained cutting out a sheet metal that constitutes the image forming apparatus body 12 in the shape of the letter V.

A guide portion 120 that guides the image forming member 30 in the insertion direction is provided within the image forming apparatus body 12. When the image forming member 30 is mounted on the image forming apparatus body 12, the guide portion 120 guides the image forming member so as to be positioned in the longitudinal direction.

An interlocking mechanism 122 is provided on the inner side of the guide portion 120 in the insertion direction.

The image forming member body 40 is provided with a first portion 130 to be positioned that is provided so as to protrude to the near side in the insertion direction, and a second portion 132 to be positioned that is provided so as to protrude to the inner side in the insertion direction.

The first portion 130 to be positioned and the second portion 132 to be positioned are provided to cover a bearing of a rotating shaft of the photoreceptor 42 so as to become concentric with the bearing.

The first positioning portion 130 is provided with an urging mechanism 140. The urging mechanism 140 is adapted so as to urge the first portion 130 to be positioned toward the first positioning portion 110 of the image forming apparatus body 12 and bring the first portion 130 to be positioned and the first positioning portion 110 into contact with each other to position the first and second portions to be positioned.

A pressing portion 142 is formed at the second positioning portion 132 so as to face the interlocking mechanism 122 of the guide portion 120. As the pressing portion 142 operates to interlock with the interlocking mechanism 122, the second portion 132 to be positioned is brought into contact with the second positioning portion 112 of the image forming apparatus body 12, and is positioned.

In this way, as the image forming member 30 is guided to the guide portion 120 and is positioned in the longitudinal direction, the first portion 130 to be positioned is brought into contact with the first positioning portion 110 and is positioned, and the second portion 132 to be positioned is brought into contact with the second positioning portion 112 and is positioned, the image forming member 30 is mounted on the image forming apparatus body 12 at a regular position.

Next, the details of the urging mechanism 140 will be described.

Figure 4:
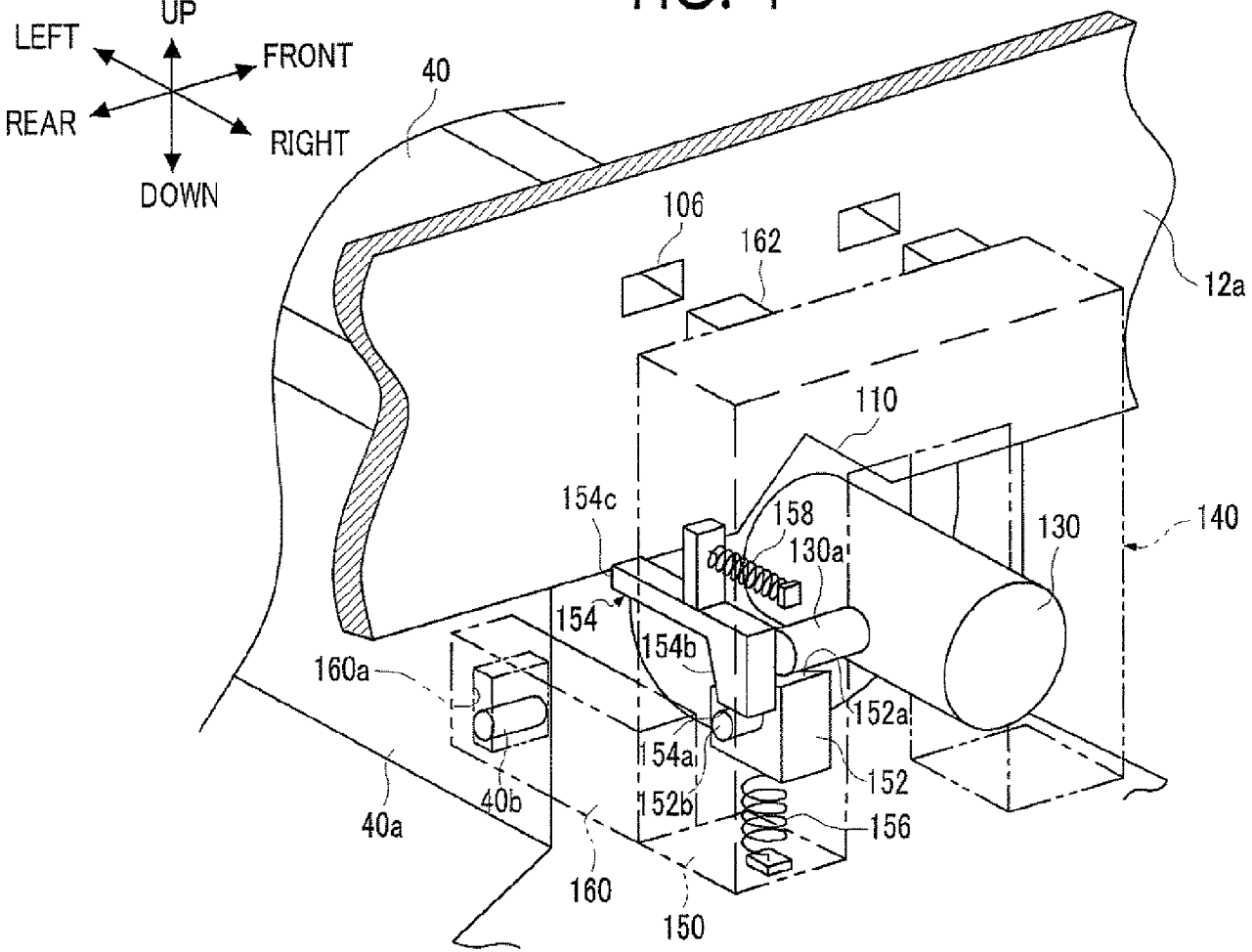
FIG. 4 is a perspective view of an urging mechanism to which one exemplary embodiment of the invention is applied, and its peripheral structure.

FIG. 4 is a perspective view of the urging mechanism 140 and its peripheral structure.

Figure 5A:
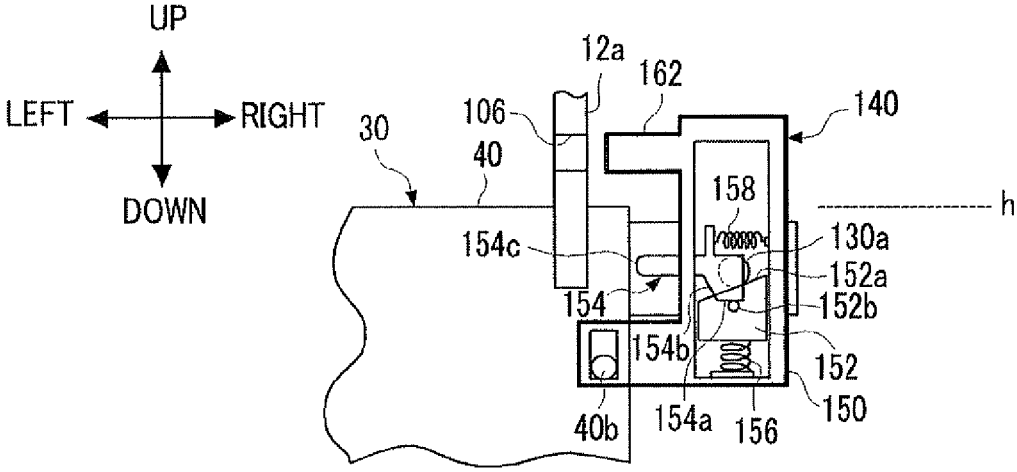
FIGS. 5A to 5C are explanatory views illustrating the urging mechanism to which one exemplary embodiment of the invention is applied, and its operation.
Figure 5B:
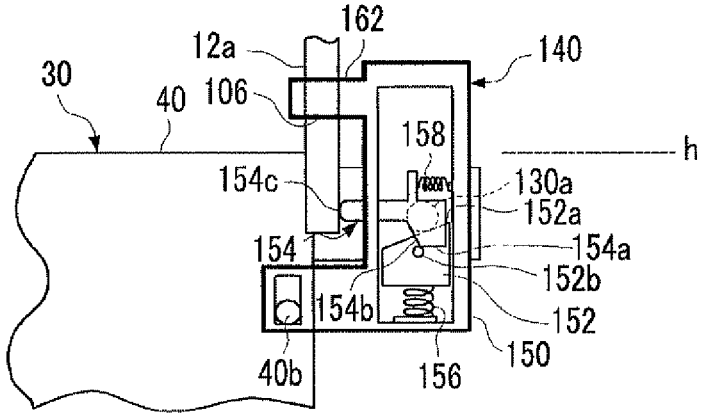
Figure 5C:
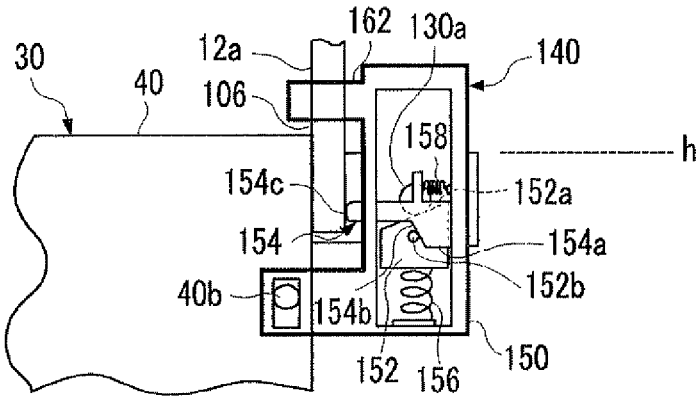

FIGS. 5A to 5C are explanatory views illustrating the urging mechanism 140 and its operation.

The urging mechanism 140 is symmetrically configured in a front-and-rear direction. Hereinafter, a rear-side portion will be described.

The urging mechanism 140 moves the image forming member body 40 between an upper position and a lower position relative to the urging mechanism 140.

The urging mechanism 140 includes an urging mechanism body 150 that is disposed so as to cover a part of the first portion 130 to be positioned. A first member 152 and a second member 154 are arranged within the urging mechanism body 150.

The first member 152 is formed with a slope portion 152*a* and a protrusion portion 152*b*. The first member 152 is urged toward the upside by the first urging member 156 constituted by, for example, a spring or the like.

The slope portion 152*a* is formed such that the right side (the near side in the insertion direction) becomes higher than left side (the inner side in the insertion direction). The slope portion 152*a* comes into contact with a protrusion portion 130*a* that protrudes toward the rear side from the first portion 130 to be positioned, at an upper part thereof.

The second member 154 is formed with a bottom face 154*a*, a slope portion 154*b*, and a pressing portion 154*c*. The second member 154 is urged toward left side by the second urging member 158 constituted by, for example, a spring or the like.

The movement of the second member 154 in the up-and-down direction is regulated by a regulating portion (not shown).

The slope portion 154*b* is formed so as to incline toward the upper left side from the bottom face 154*a*.

The pressing portion 154*c* is formed so as to protrude to the left side from the urging mechanism body 150.

The urging mechanism body 150 is provided with a communication portion 160 that extends along a rear face 40*a* of the image forming member body 40, and a hooking portion 162 that protrudes in the longitudinal direction.

The communication portion 160 is formed with a communication opening 160*a* that opens in the front-and-rear direction, and a protrusion portion 40*b* that protrudes toward the rear side from the face 40*a* of the image forming member body 40 fits to the communication opening 160*a* so as to be movable in the up-and-down direction.

The hooking portion 162 fits into the hooked portion 106 of the image forming apparatus body 12 when the image forming member 30 is mounted on the image forming apparatus body 12.

As shown in FIG. 5A, before the image forming member 30 is mounted on the image forming apparatus body 12, the image forming member body 40 is brought into the state of being located on a side ("lower side" in the present exemplary embodiment) far from the first positioning portion 110.

In FIGS. 5A to 5C, an undulating line h indicates a position in the up-and-down direction when the first portion 130 to be positioned is positioned by the first positioning portion 110.

Specifically, the second member 154 is at a position urged to the left side by the second urging member 158, and the bottom face 154*a* is located at an upper part of the protrusion portion 152*b* of the first member 152. For this reason, upward urging of the first member 152 by the first urging member 156 is regulated.

Accordingly, an upward urging force is not transmitted to the protrusion portion 130*a* of the first portion 130 to be positioned that is located on the slope 152*a* of the first member 152, and the image forming member body 40 is at a lower position.

When the image forming member 30 is inserted into the image forming apparatus body 12 as shown in FIG. 5B, the pressing portion 154*c* of the second member 154 is pressed against the wall portion 12*a*, and the second member 154 begins to move to the right side against the urging force of the second urging member 158.

Additionally, the hooking portion 162 fits into the hooked portion 106 of the wall portion 12*a*. Thereby, the urging mechanism body 150 itself is brought into a state where the position thereof in the up-and-down direction is fixed with respect to the image forming apparatus body 12.

When the image forming member 30 is mounted on the image forming apparatus body 12 as shown in FIG. 5C, the image forming member body 40 is brought into the state of being located on the upper side if the position of the image forming member in the longitudinal direction is determined according to the guide portion 120.

Specifically, the second member 154 moves to the right side while coming into contact with the protrusion portion 152*b* of the first member 152 so as to run along the slope 154*b* from the bottom face 154*a*. When the pressing portion 154*c* is pressed upward to a predetermined position, the second member 154 separates from the protrusion portion 152*b*. Thereby, the regulation of the first urging member 156 is released, and the first member 152 moves upward.

When the first member 152 moves upward, the protrusion portion 130*a* that comes into contact with the slope portion 152*a* moves upward. According to this, the image forming member body 40 moves upward until the first portion 130 to be positioned comes into contact with the first positioning portion 110.

The near side of the image forming member body 40 in the insertion direction is positioned in the up-and-down direction.

In this way, the urging mechanism 140 is switched between states where an urging force acts on and does not act on the first portion 130 to be positioned of the image forming member body 40.

At this time, an upper end of the image forming member body 40 is at a position higher than an upper end of the opening 102. For this reason, when the image forming member 30 is mounted, the image forming member body 40 is in a state where the movement of the image forming member in the insertion direction is regulated.

When the image forming member 30 is detached from the image forming apparatus 12, the image forming apparatus body 40 is once moved down, and is then moved to the near side in the insertion direction.

In this way, the first portion 130 to be positioned or the second portion 132 to be positioned is separated from the first positioning portion 110 or the second positioning portion 112, and is then moved in the longitudinal direction.

Next, the details of the interlocking mechanism 122 will be described.

FIGS. 6A to 6D are explanatory views illustrating the interlocking mechanism 122 and its operation.

Figure 7A:
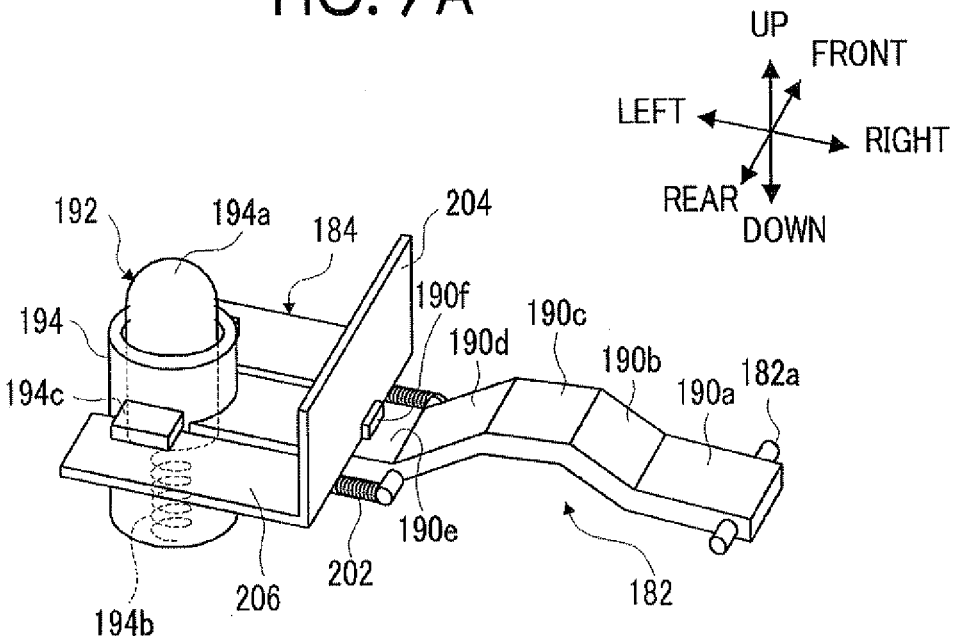
FIGS. 7A and 7B are perspective views of an interlocking member and a movable member to which one exemplary embodiment of the invention is applied.
Figure 7B:
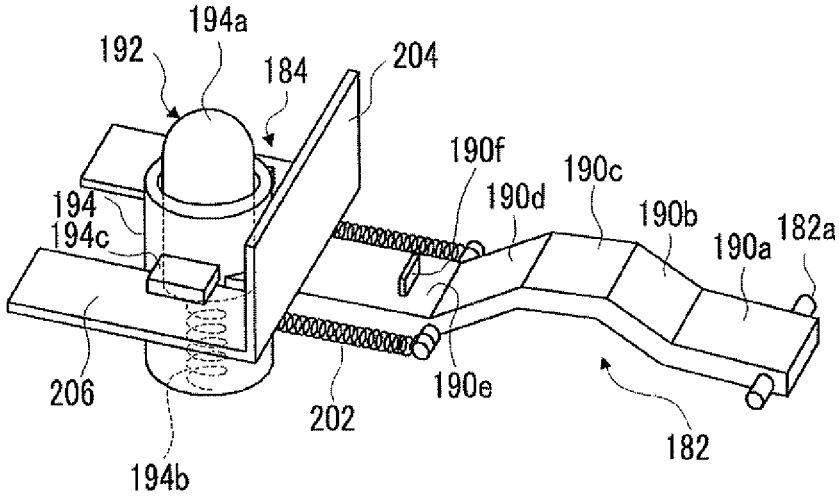

FIGS. 7A and 7B are perspective views of the interlocking member 182 and the movable member 184.

The interlocking mechanism 122 is constituted by a foundation portion 180, the interlocking member 182, and the movable member 184.

A protrusion portion 180*a* that protrudes toward the upper side is formed on the right side of the foundation portion 180, and an inclined portion 180*b* is formed on the left side of the foundation portion 180.

A first elastic member 186 constituted by an elastic member, such as a spring, is provided at the foundation portion 180, and the first elastic member 186 supports the interlocking member 182 from below.

The first elastic member 186 is configured so as to have such an elastic force that the first elastic member contracts according to insertion of the image forming member 30 (so as not to have such an elastic force that the image forming member 30 to be inserted is moved upward), and to have such an elastic force that the interlocking member 182 is returned to a predetermined position when the force applied to the interlocking member 182 is released.

The interlocking member 182 is provided so as to be capable of oscillating with a pivot 182*a* supported on the protrusion portion 180*a* as a supporting point.

A first parallel surface 190*a*, a first inclined surface 190*b*, a second parallel surface 190*c*, a second inclined surface 190*d*, and a third parallel surface 190*e* are formed in the interlocking member 182 sequentially from the near side in the insertion direction.

An urging portion 192 is provided on the inner side of the third parallel surface 190*e* in the insertion direction.

The first parallel surface 190*a*, the second parallel surface 190*c*, and the third parallel surface 190*e* are formed so as to become substantially parallel to the insertion direction in a state where an external force does not act on the interlocking member 182.

The first inclined surface 190*b* inclines toward the upper left side, and comes into contact with the pressing portion 142 of the image forming member 30 when the image forming member 30 is mounted on the image forming apparatus body 12.

The second inclined surface 190*d* inclines toward the lower left side.

A movement regulating portion 190*f* is formed at an upper part of the third parallel surface 190*e*.

The urging portion 192 includes a housing 194.

A pressing portion 194*a*, and an urging member 194*b* that urges the pressing portion 194*a* toward the upper side are provided within the housing 194. Additionally, the housing 194 is formed with a portion 194*c* to be supported that protrudes in the front-and-rear direction.

The movable member 184 is provided so as to move along the third parallel surface 190*e*. The movable member 184 is urged toward the near side in the insertion direction by the second elastic member 202 provided at the interlocking member 182.

The movable member 184 is provided with a portion 204 to be pressed and a supporting portion 206.

When the image forming member 30 is mounted, the portion 204 to be pressed is pressed against the pressing portion 142 of the image forming member 30.

The supporting portion 206 is arranged so as to support the portion 194*c* to be supported of the urging portion 192 from below. When the image forming member 30 is mounted, the tip of the supporting portion 206 comes into contact with the inclined portion 180*b* of the foundation portion 180, and moves along the inclination of the inclined portion 180*b*.

As the image forming member 30 is inserted into the image forming apparatus body 12, the portion 204 to be pressed is pressed against the pressing portion 142. Thereby, the movable member 184 moves to the inner side in the insertion direction (moves from a position shown in FIG. 7A to a position shown in FIG. 7B).

When pressing against the portion 204 to be pressed is released, the movable member 184 moves to the near side in the insertion direction up to a position where the portion 204 to be pressed comes into contact with the movement regulating portion 190*f*.

As shown in FIG. 6A, the interlocking member 182 is at an initial position according to the elastic force of the first elastic member 186 before coming into contact with the pressing portion 142.

When the image forming member 30 is inserted into the image forming apparatus body 12, the pressing portion 142 is pressed against the first inclined surface 190*b*.

As shown in FIG. 6B, when the image forming member 30 is further inserted from a position shown in FIG. 6A, the pressing portion 142 moves along a second parallel surface 190*c* from the first inclined surface 190*b*. In conjunction with this, the interlocking member 182 is brought into a state where the inner side in the insertion direction goes down against the elastic force of the first elastic member 186.

Figure 6C:
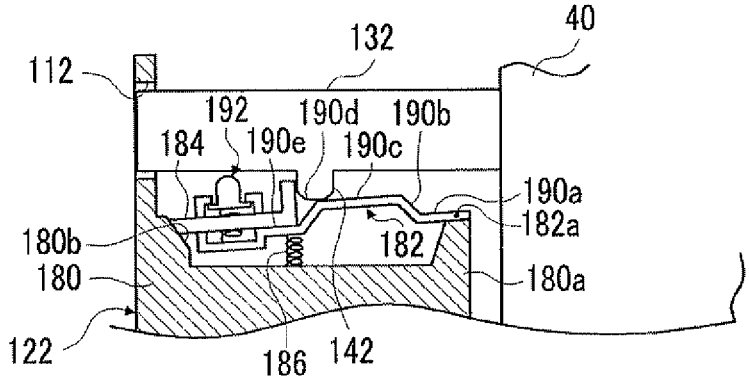

As shown in FIG. 6C, when the image forming member 30 is further inserted from the position shown in FIG. 6B, the pressing portion 142 moves along the second inclined surface 190*d* from the second parallel surface 190*c*, and is pressed against the portion 204 to be pressed of the movable member 184.

In this case, the pressing portion 142 comes into contact with the interlocking member 182 (the second parallel surface 190*c* or the second inclined surface 190*d*), and this interlocking member 182 is brought into a state where the inner side in the insertion direction goes down against the elastic force of the first elastic member 186.

On the other hand, as the pressing portion 142 is pressed against the portion 204 to be pressed, the movable member 184 moves to the inner side in the insertion direction (refer to FIG. 7) against the elastic force of the second elastic member 202, and the tip of the supporting portion 206 comes into contact with the inclined portion 180*b* of the foundation portion 180.

Figure 6D:
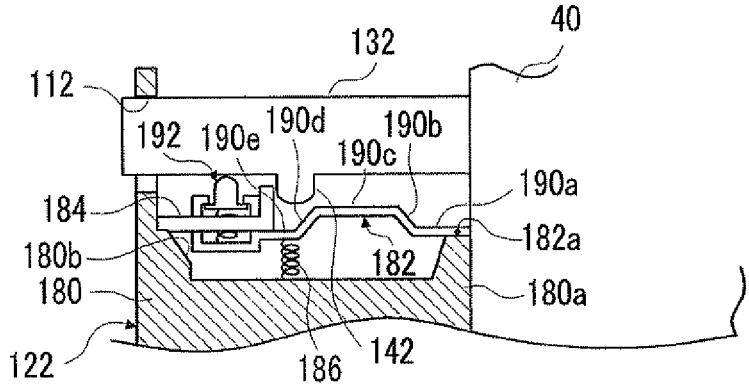

As shown in FIG. 6D, when the image forming member 30 is further inserted from the position shown in FIG. 6C, the pressing portion 142 moves the movable member 184 to the inner side in the insertion direction while moving along the second inclined surface 190*d*.

In this case, as the tip of the supporting portion 206 moves along the inclined portion 180*b*, the inner side of the interlocking member 182 in the insertion direction is gradually moved upward.

Then, when the image forming member 30 is inserted to a position in the longitudinal direction determined according to the guide portion 120, the pressing portion 194*a* of the urging portion 192 comes into contact with the second portion 132 to be positioned.

Thereby, the second portion 132 to be positioned is biased upward, and the second portion 132 to be positioned comes into contact with the second positioning portion 112.

In this way, the inner side of the image forming member body 40 in the insertion direction is positioned in the up-and-down direction.

In the image forming apparatus 10, after the position of the image forming member 30 in the longitudinal direction is determined, the position of the image forming member in the up-and-down direction is determined, and thereby, the image forming member 30 is mounted on the image forming apparatus body 12.

For this reason, when the image forming member 30 is mounted on the image forming apparatus body 12, the movement of the image forming member in the longitudinal direction in a state where the first portion 130 to be positioned or the second portion 132 to be positioned comes into contact with the first positioning portion 110 or the second positioning portion 112 is not required.

Second Exemplary Embodiment

Next, a second exemplary embodiment will be described.

In the second exemplary embodiment, an urging mechanism 220 is provided instead of the urging mechanism 140 of the first exemplary embodiment.

Figure 8:
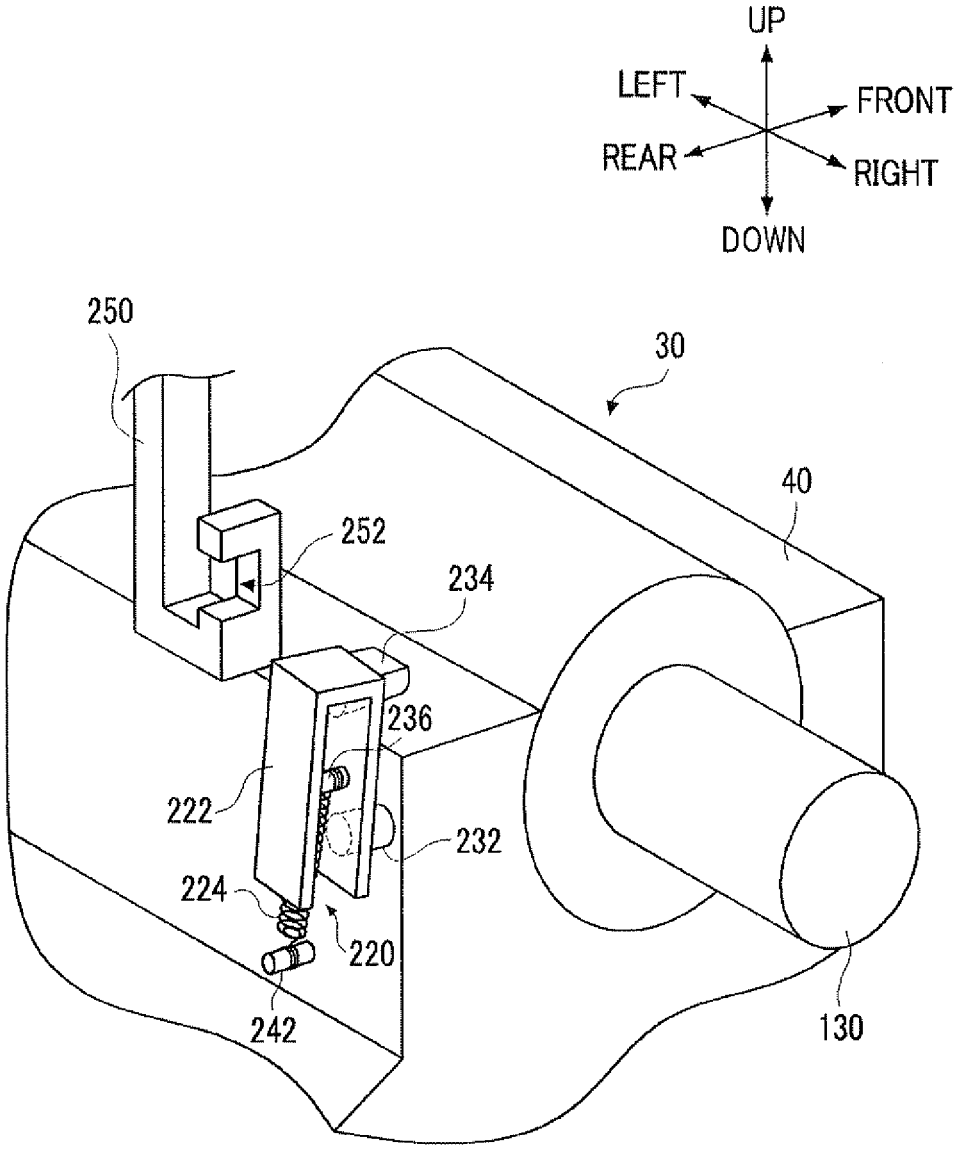
FIG. 8 is a perspective view of an urging mechanism related to a second exemplary embodiment, and its peripheral structure.

FIG. 8 is a perspective view of the urging mechanism 220 and its peripheral structure.

FIGS. 9A to 9D are explanatory views illustrating the urging mechanism 220 and its operation.

The urging mechanism 220 is constituted as a toggle mechanism.

The urging mechanism 220 is provided on the rear side of the first portion 130 to be positioned. In addition, the urging mechanisms 220 may be provided on both sides in the front-and-rear direction with respect to the first portion 130 to be positioned.

The urging mechanism 220 includes a turning member 222, and a toggle urging member 224 constituted by, for example, a spring or the like.

The turning member 222 is turnably disposed with a rotation supporting point 232 fixed to the image forming apparatus body 40 as a supporting point.

A hooking portion 234 that protrudes to the front side is provided at an upper end of the turning member 222, and a locking portion 236 that locks an upper end of the toggle urging member 224 is provided at a substantially central portion of the turning member.

The hooking portion 234 is formed in a shape (D cut) obtained by forming a columnar tip in a non-circular shape. The hooking portion 234 comes into contact with a turning regulating portion 40*c* provided at the image forming apparatus body 40 in a state where the image forming member 30 is not mounted on the image forming apparatus body 12, and is arranged such that the D cut-shaped planar portion faces upward.

The protrusion portion 40*b* functions as a member that determines the position of the urging mechanism 220 when the image forming member 30 is mounted.

The toggle urging member 224 has one end locked to a locking portion 236 of the turning member 222, and the other end locked to a shank 242 fixed to the image forming member body 40. The toggle urging member 224 requires a force in a direction in which the toggle urging member is to be contracted.

A hooked portion 250 is provided in the wall portion 12*a* of the image forming apparatus body 12 so as to protrude to the near side in the insertion direction. A groove portion 252 through which the hooking portion 234 of the turning member 222 passes is formed on the near side of the hooked portion 250 in the insertion direction.

The length of a groove of the groove portion 252 in the up-and-down direction is set to such a length that the hooking portion can pass through the groove portion when the D-cut shaped planar portion of the hooking portion 234 faces upward.

Figure 9A:
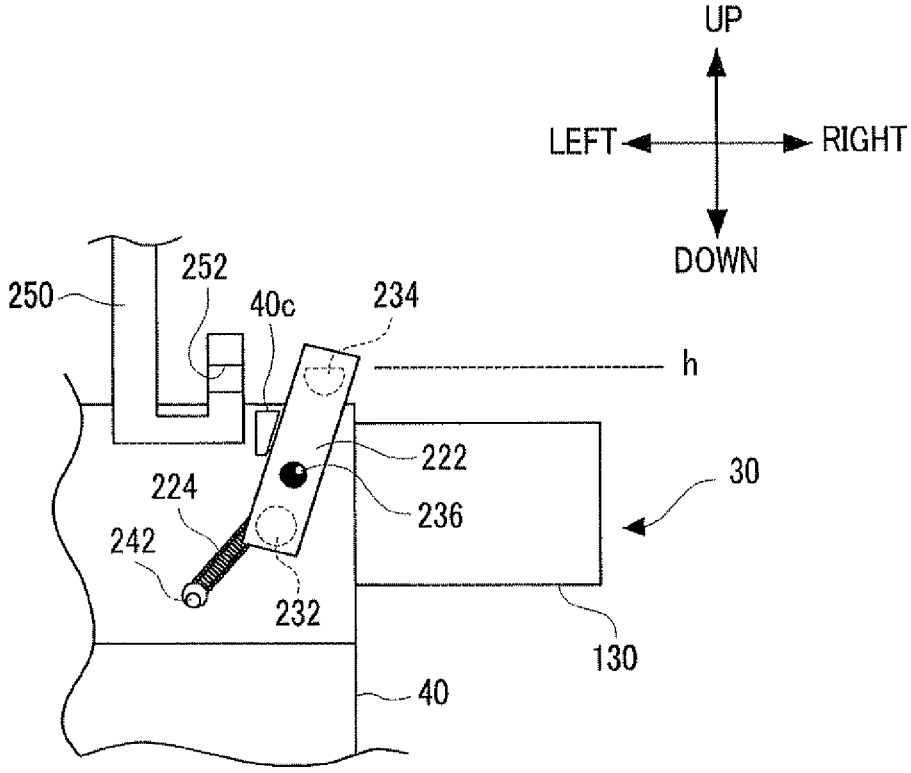
FIGS. 9A to 9D are explanatory views illustrating the urging mechanism related to the second exemplary embodiment, and its operation.

As shown in FIG. 9A, before the image forming member 30 is mounted on the image forming apparatus body 12, the image forming member body 40 is brought into the state of being located on a side ("lower side" in the present exemplary embodiment) far from the first positioning portion 110.

In FIGS. 9A to 9D, an undulating line h indicates a position in the up-and-down direction when the first portion 130 to be positioned is positioned by the first positioning portion 110.

In this case, the angle formed by a straight line that connects the locking portion 236 and the hooking portion 234 and a straight line that connects the locking portion 236 and the shank 242 is made smaller on the inner side in the insertion direction than the near side in the insertion direction.

Figure 9B:
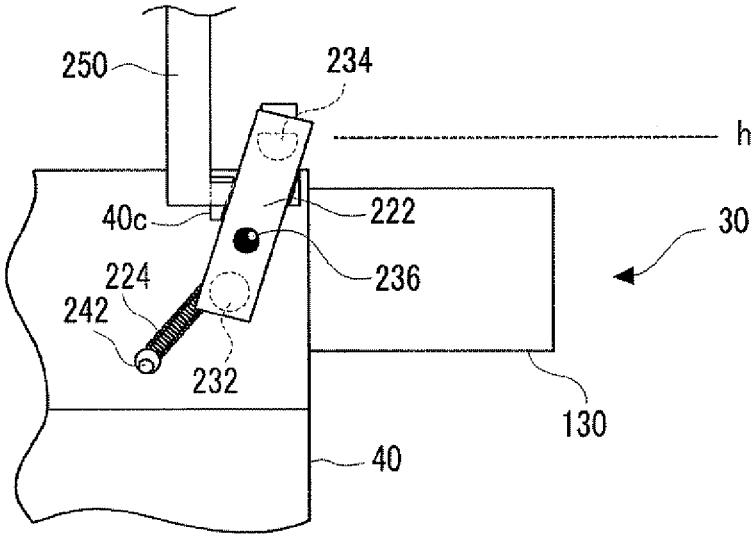

When the image forming member 30 is inserted into the image forming apparatus body 12 as shown in FIG. 9B, the hooking portion 234 passes through the groove portion 252.

Figure 9C:
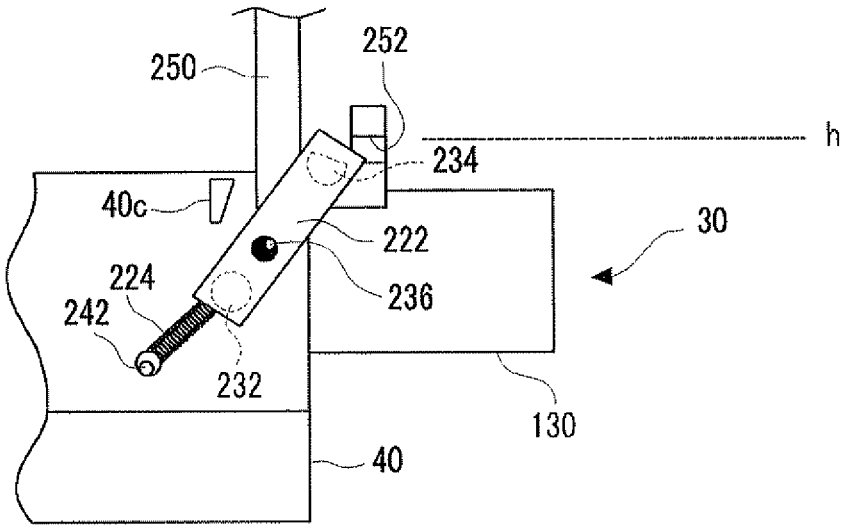

As shown in FIG. 9C, when the image forming member 30 is further inserted from the position shown in FIG. 9B, the hooking portion 234 is hooked in the hooked portion 250. Then, the turning member 222 rotates clockwise.

Figure 9D:
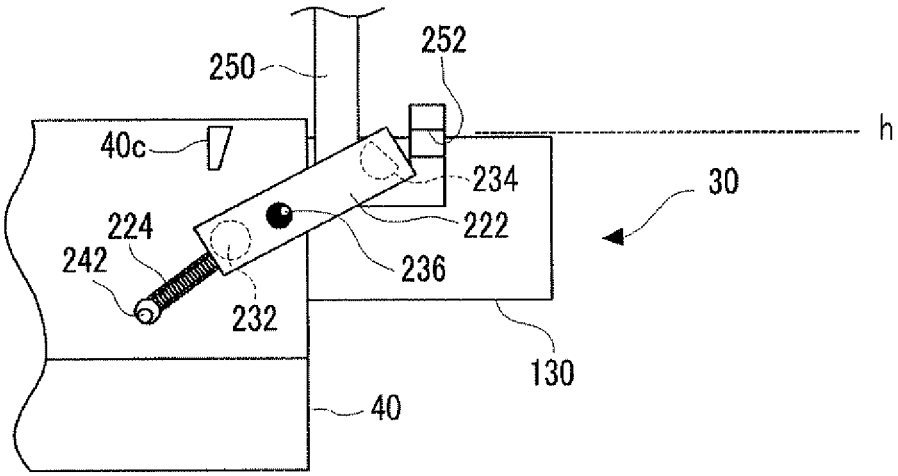

As shown in FIG. 9D, when the image forming member 30 is further inserted from the position shown in FIG. 9C and the position of the image forming member in the longitudinal direction is determined according to the guide portion 120, the image forming member body 40 is brought into the state of being located on the upper side.

Specifically, the turning member 222 rotates clockwise, and exceeds a position that balances with the toggle urging member 224 in a rotational direction. Thereby, the toggle urging member 224 moves the image forming member body 40 relatively upward with the locking portion 236 as a supporting point.

Thereby, the image forming member body 40 moves upward until the first portion 130 to be positioned comes into contact with the first positioning portion 110.

In this case, the angle formed by a straight line that connects the locking portion 236 and the hooking portion 234 and a straight line that connects the locking portion 236 and the shank 242 is made larger on the inner side in the insertion direction than the near side in the insertion direction.

In the second exemplary embodiment, the near side of the image forming member body 40 in the insertion direction is positioned in the up-and-down direction.

In this way, the urging mechanism 220 is switched between states where an urging force acts on and does not act on the first portion 130 to be positioned of the image forming member body 40.

At this time, an upper end of the image forming member body 40 is at a position higher than an upper end of the opening 102. For this reason, when the image forming member 30 is mounted, the image forming member body 40 is in a state where the movement of the image forming member in the insertion direction is regulated.

When the image forming member 30 is detached from the image forming apparatus 12, the image forming apparatus body 40 is once moved down, and is then moved to the near side in the insertion direction. Thereby, the turning member 222 rotates counterclockwise, and the turning member 222 exceeds a position that balances with the toggle urging member 224 in the rotational direction.

Then, the toggle urging member 224 relatively moves the image forming member body 40 downward with the locking portion 236 as a supporting point, and is arranged such that the D cut-shaped planar portion of the hooking portion 234 faces upward.

In this way, the image forming member body 40 is detached from the image forming apparatus body 12.

Third Exemplary Embodiment

Next, a third exemplary embodiment will be described.

In the third exemplary embodiment, an urging mechanism 320 is provided instead of the urging mechanism 140 of the first exemplary embodiment.

Figure 10:
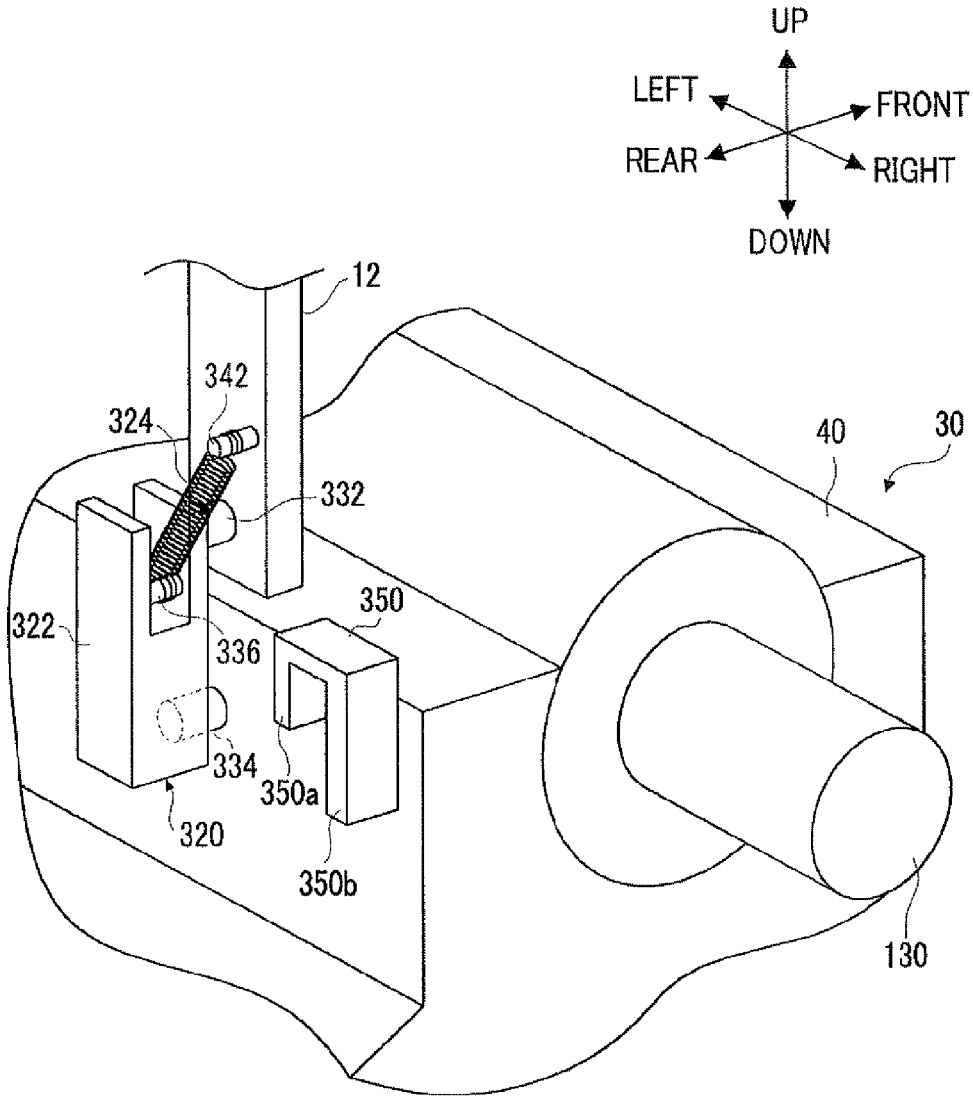
FIG. 10 is a perspective view of an urging mechanism related to a third exemplary embodiment, and its peripheral structure.

FIG. 10 is a perspective view of the urging mechanism 320 and its peripheral structure.

FIGS. 11A to 11D are explanatory views illustrating the urging mechanism 320 and its operation.

The urging mechanism 320 is constituted as a toggle mechanism, and this urging mechanism 320 is provided on the image forming apparatus body 12 side. The urging mechanism 320 is provided on the rear side of the first portion 130 to be positioned of the image forming member body 40 inserted into the image forming apparatus body 12.

In addition, the urging mechanisms 320 may be provided on both sides in the front-and-rear direction with respect to the first portion 130 to be positioned.

In the third exemplary embodiment, the urging mechanism 320 is provided inside the wall portion 12*a* of the image forming apparatus body 12.

The urging mechanism 320 includes a turning member 322, and a toggle urging member 324 constituted by, for example, a spring or the like.

The turning member 322 is turnably disposed with a rotation supporting point 332 fixed to the image forming apparatus body 12 side as a supporting point.

A hooking portion 334 that protrudes to the front side is provided at a lower end of the turning member 322, and a locking portion 336 that locks a lower end of the toggle urging member 324 is provided substantially at a central portion of the turning member.

The toggle urging member 324 has a lower end locked to a locking portion 336 of the turning member 322, and an upper end locked to a shank 342 fixed to the image forming apparatus body 12. The toggle urging member 324 requires a force in the direction in which the toggle urging member is to be contracted.

The image forming member body 40 is provided with a hooked portion 350. The hooked portion 350 includes a first wall portion 350*a*, and a second wall portion 350*b* formed closer to the near side in the insertion direction than the first wall portion 350*a*.

The first wall portion 350*a* is configured such that the lower end thereof is located above a lower end of the second wall portion 350*b*.

Figure 11A:
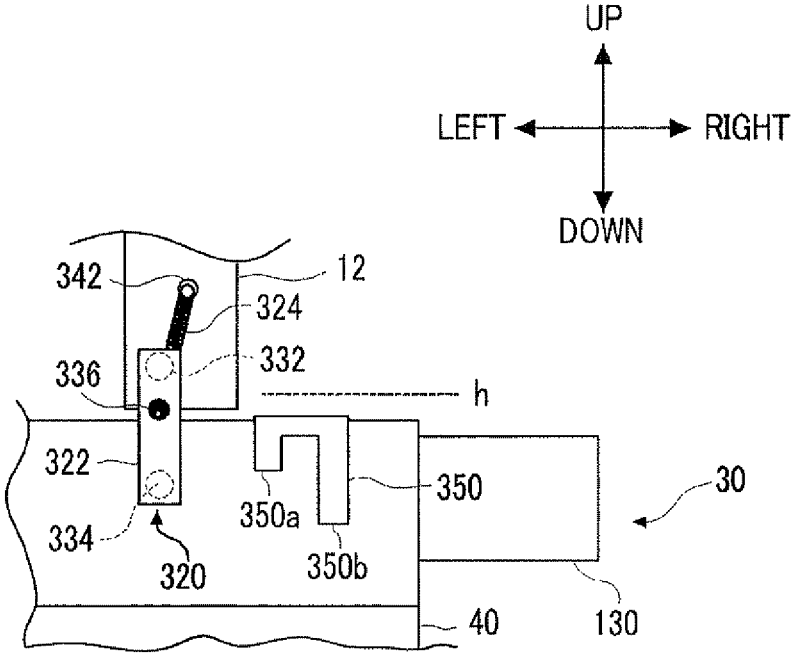
FIGS. 11A to 11D are explanatory views illustrating an urging mechanism related to a third exemplary embodiment, and its operation.

As shown in FIG. 11A, before the image forming member 30 is mounted on the image forming apparatus body 12, the urging mechanism 320 is brought into a state where the hooking portion 334 of the turning member 322 is located on a side (a "lower side" in the present exemplary embodiment) far from the first positioning portion 110.

In FIGS. 11A to 11D, an undulating line h indicates a position in the up-and-down direction when the first portion 130 to be positioned is positioned by the first positioning portion 110.

In this case, the angle formed by a straight line that connects the locking portion 336 and the hooking portion 334 and a straight line that connects the locking portion 336 and the shank 342 is made smaller on the inner side in the insertion direction than the near side in the insertion direction.

Figure 11B:
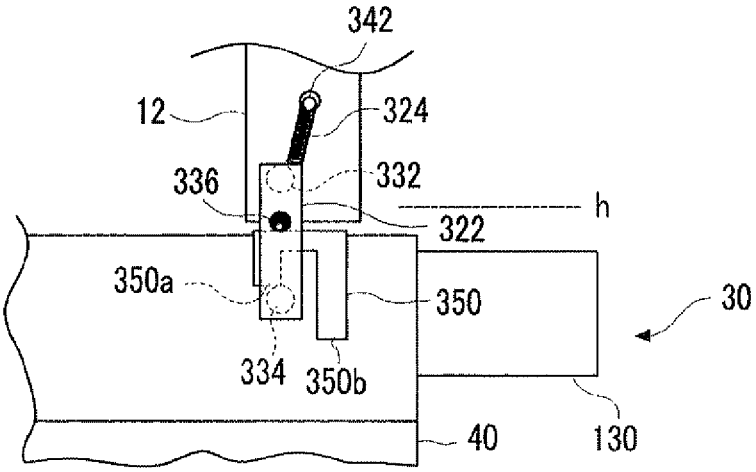

When the image forming member 30 is inserted into the image forming apparatus body 12 as shown in FIG. 11B, the hooked portion 350 of the image forming member body 40 passes under the wall portion 12*a*. At this time, a lower end of the first wall portion 350*a* of the hooked portion 350 is made not come into contact with the hooking portion 334 of the turning member 322.

Figure 11C:
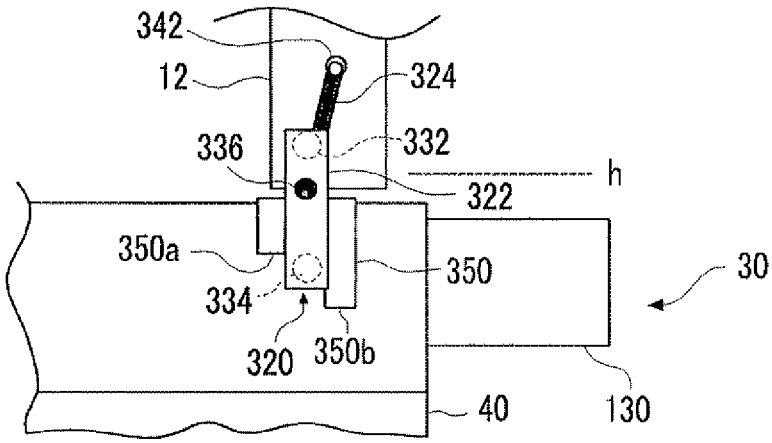

As shown in FIG. 11C, when the image forming member 30 is further inserted from the position shown in FIG. 11B, the hooking portion 334 comes into contact with and is hooked in the second wall portion 350*b* of the hooked portion 350.

Figure 11D:
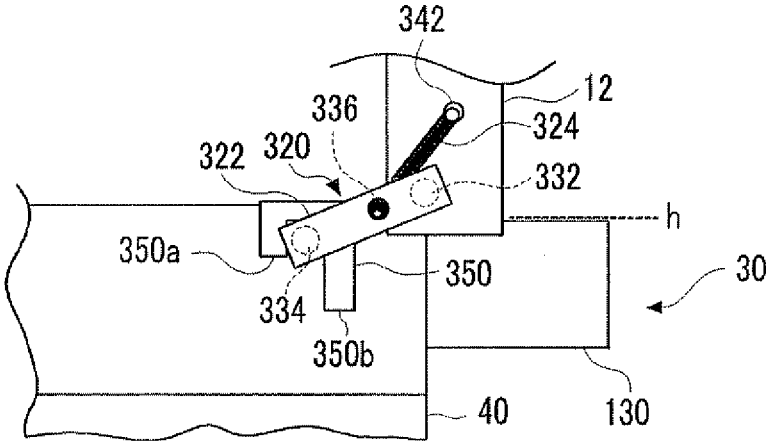

As shown in FIG. 11D, when the image forming member 30 is further inserted from the position shown in FIG. 11C, the turning member 322 rotates clockwise.

Then, when the image forming member 30 is positioned in the longitudinal direction according to the guide portion 120, the image forming member body 40 is brought into the state of being located on the upper side.

Specifically, when the turning member 322 rotates clockwise, the turning member 322 exceeds a position that balances with the toggle urging member 324 in the rotational direction. Thereby, the toggle urging member 324 moves the image forming member body 40 upward with the locking portion 336 as a supporting point.

Thereby, the image forming member body 40 moves upward until the first portion 130 to be positioned comes into contact with the first positioning portion 110.

In this case, the angle formed by a straight line that connects the locking portion 336 and the hooking portion 334 and a straight line that connects the locking portion 336 and the shank 342 is made larger on the inner side in the insertion direction than the near side in the insertion direction.

In the third exemplary embodiment, the near side of the image forming member body 40 in the insertion direction is positioned in the up-and-down direction.

In this way, the urging mechanism 320 is switched between states where an urging force acts on and does not act on the first portion 130 to be positioned of the image forming member body 40.

At this time, an upper end of the image forming member body 40 is at a position higher than an upper end of the opening 102. For this reason, when the image forming member 30 is mounted, the image forming member body 40 is in a state where the movement of the image forming member in the insertion direction is regulated.

When the image forming member 30 is detached from the image forming apparatus 12, the image forming apparatus body 40 is once moved down, and is then moved to the near side in the insertion direction. Thereby, the turning member 322 rotates counterclockwise, and the turning member 322 exceeds a position that balances with the toggle urging member 224 in the rotational direction.

Then, the toggle urging member 324 moves the image forming member body 40 downward with the locking portion 336 as a supporting point.

In this way, the image forming member body 40 is detached from the image forming apparatus body 12.

Fourth Exemplary Embodiment

Next, a fourth exemplary embodiment will be described.

In the fourth exemplary embodiment, an interlocking mechanism 422 is provided instead of the interlocking mechanism 122 of the first exemplary embodiment.

FIGS. 12A to 12D are explanatory views illustrating the interlocking mechanism 422 and its operation.

The interlocking mechanism 422 is constituted by the foundation portion 180, the interlocking member 182, and a lever member 510.

The lever member 510 is rotatably provided, with a pivot 510*a* supported by the interlocking member 182 as a supporting point. The lever member 510 is urged in the clockwise direction by an elastic member (not shown).

The lever member 510 is provided with a portion 514 to be pressed, and an action portion 516.

When the image forming member 30 is mounted, the portion 514 to be pressed is pressed against the pressing portion 142 of the image forming member 30.

The action portion 516 comes into contact with the foundation portion 180 when the lever member 510 turns counterclockwise.

Figure 12A:
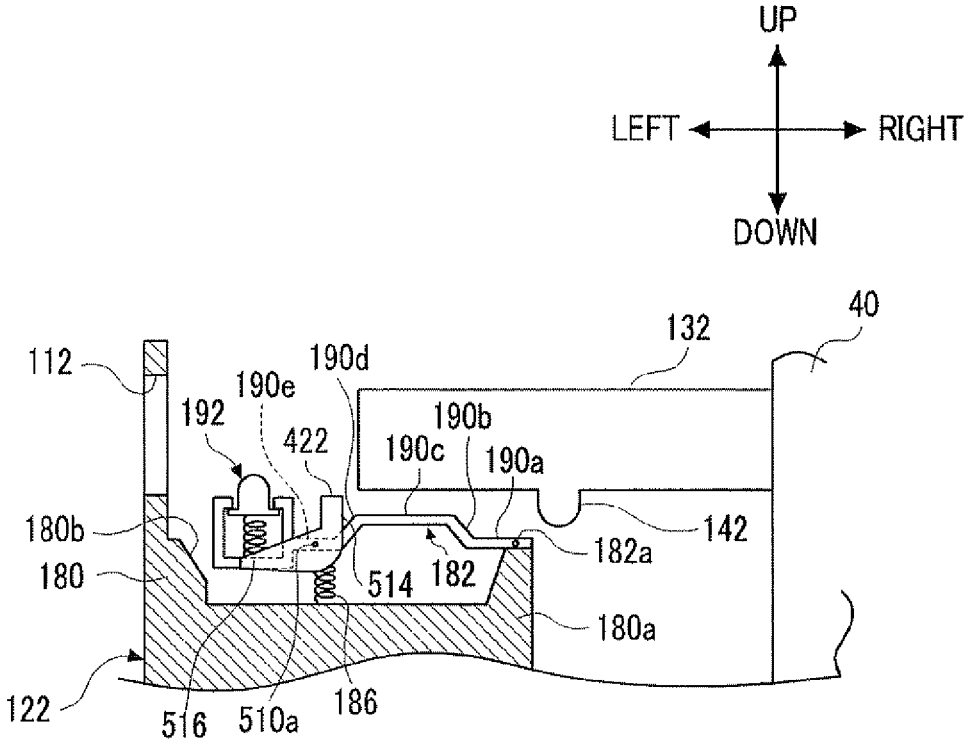
FIGS. 12A to 12D are explanatory views illustrating an interlocking mechanism related to the fourth exemplary embodiment, and its operation.

As shown in FIG. 12A, the interlocking member 182 is at an initial position before coming into contact with the pressing portion 142.

When the image forming member 30 is inserted into the image forming apparatus body 12, the pressing portion 142 is pressed against the first inclined surface 190*b*.

Figure 12B:
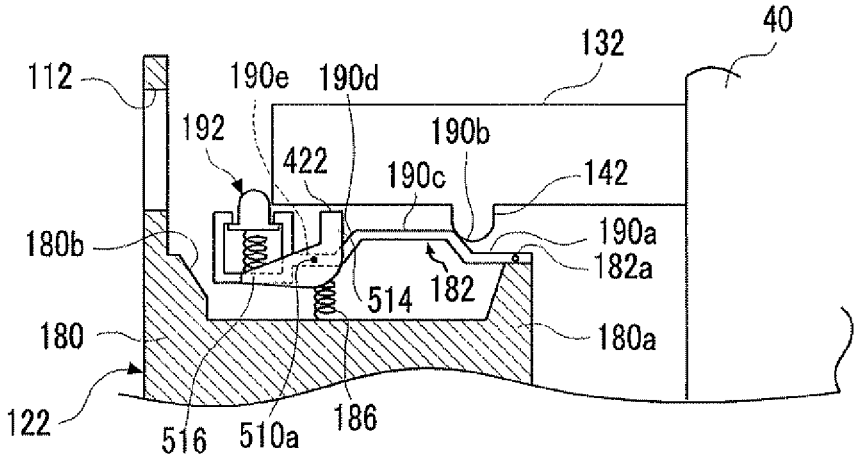

As shown in FIG. 12B, when the image forming member 30 is further inserted from a position shown in FIG. 12A, the pressing portion 142 moves along a second parallel surface 190*c* from the first inclined surface 190*b*. The interlocking member 182 is brought into a state where the inner side in the insertion direction goes down against the elastic force of the first elastic member 186.

Figure 12C:
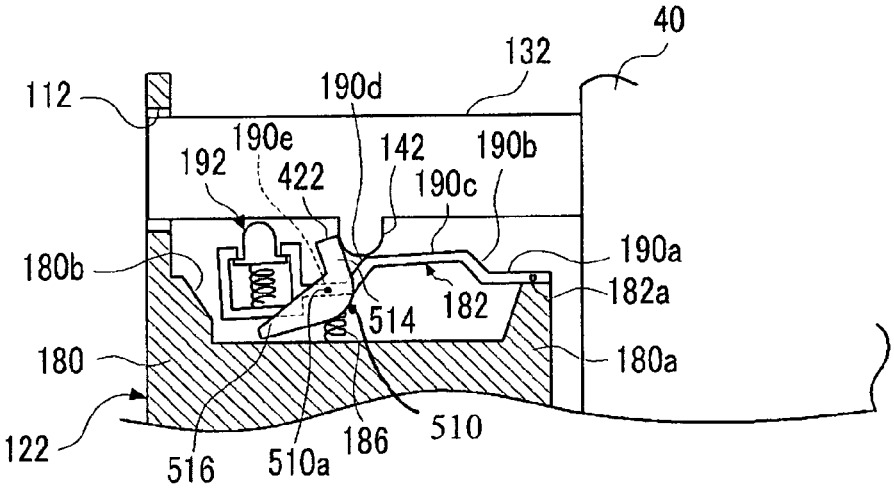

As shown in FIG. 12C, when the image forming member 30 is further inserted from the position shown in FIG. 12B, the pressing portion 142 moves along the second inclined surface 190*d* from the second parallel surface 190*c*, and is pressed against the portion 514 to be pressed of the lever member 510.

In this case, the pressing portion 142 comes into contact with the interlocking member 182 (the second parallel surface 190*c* or the second inclined surface 190*d*), and this interlocking member 182 is brought into a state where the inner side in the insertion direction goes down against the elastic force of the first elastic member 186.

On the other hand, as the pressing portion 142 is pressed against the portion 514 to be pressed, the lever member 510 is rotated counterclockwise against the elastic force of an elastic member (not shown) that urges this lever.

Figure 12D:
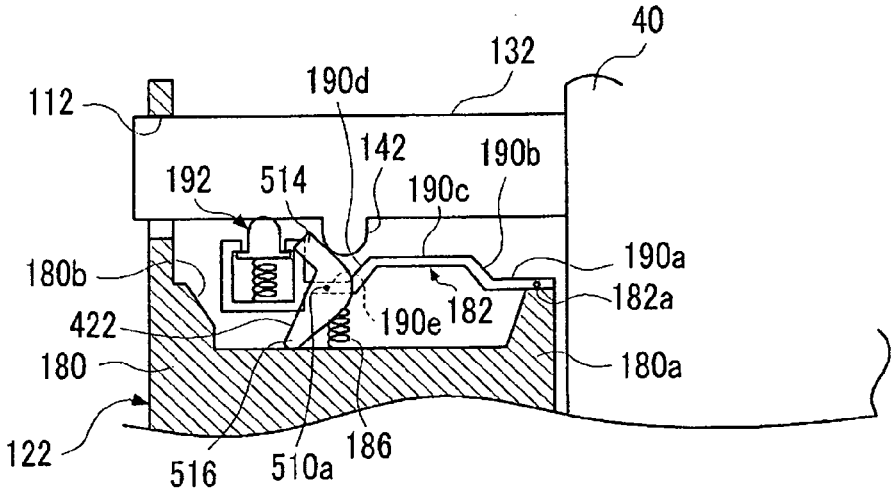

As shown in FIG. 12D, when the image forming member 30 is further inserted from the position shown in FIG. 12C, the pressing portion 142 further rotates the lever member 510 while moving along the second inclined surface 190*d*. Thereby, the action portion 516 comes into contact with the foundation portion 180.

As the lever member 510 is further rotated in a state where the action portion 516 comes into contact with the foundation portion 180, the inner side the interlocking member 182 in the insertion direction moves upward according to the principle of the lever.

Then, when the image forming member 30 is inserted to a position in the longitudinal direction determined according to the guide portion 120, the pressing portion 194*a* of the urging portion 192 comes into contact with the second portion 132 to be positioned.

Thereby, the second portion 132 to be positioned is biased upward, and the second portion 132 to be positioned comes into contact with the second positioning portion 112.

In the fourth exemplary embodiment, the inner side of the image forming member body 40 in the insertion direction is positioned in the up-and-down direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an apparatus body including a positioning portion;

a replaceable member that is provided so as to be attachable to and detachable from the apparatus body, and has a portion to be positioned that comes into contact with and is positioned by the positioning portion at least at one longitudinal end; and an urging mechanism that urges the portion to be positioned toward the positioning portion, wherein the urging mechanism is switched between a state where an urging force acts on the portion to be positioned and a state where an urging force does not act on the portion to be positioned, and wherein, when the position of the replaceable member in a longitudinal direction is determined, the replaceable member is mounted on the apparatus body as the urging mechanism is switched from the state where the urging force of the urging mechanism does not act to the state where the urging force of the urging mechanism acts so that the positioning portion and the portion to be positioned come into contact with each other, the urging mechanism is a toggle mechanism, and when the position of the replaceable member in the longitudinal direction is determined with respect to the apparatus body, the positioning portion and the portion to be positioned are pressed and bent so as to be brought into contact with each other.

2. The image forming apparatus according to claim 1, wherein the urging mechanism has an urging member, and a regulating member that regulates the urging force of the urging member, and wherein the regulating member releases regulation when the position of the replaceable member in the longitudinal direction is determined with respect to the apparatus body.

3. The image forming apparatus according to claim 2, wherein the replaceable member has an image carrier, and the portion to be positioned is provided so as to become concentric with a rotating shaft of the image carrier.

4. The image forming apparatus according to claim 3, wherein the positioning portion is a cut-out that is formed in the shape of the letter V in a sheet metal that constitutes the apparatus body.

5. The image forming apparatus according to claim 3, further comprising:

an insertion portion that inserts the replaceable member into the image forming apparatus body; and a guide portion that guides the replaceable member from a first side provided at the insertion portion toward a second side thereof, wherein the positioning portion is provided on the first side.

6. The image forming apparatus according to claim 2, wherein the positioning portion is a cut-out that is formed in the shape of the letter V in a sheet metal that constitutes the apparatus body.

7. The image forming apparatus according to claim 6, further comprising:

an insertion portion that inserts the replaceable member into the image forming apparatus body; and a guide portion that guides the replaceable member from a first side provided at the insertion portion toward a second side thereof, wherein the positioning portion is provided on the first side.

8. The image forming apparatus according to claim 2, further comprising:

an insertion portion that inserts the replaceable member into the image forming apparatus body; and a guide portion that guides the replaceable member from a first side provided at the insertion portion toward a second side thereof, wherein the positioning portion is provided on the first side.

9. The image forming apparatus according to claim 1, further comprising:

an insertion portion that inserts the replaceable member into the image forming apparatus body; and a guide portion that guides the replaceable member from a first side provided at the insertion portion toward a second side thereof, wherein the positioning portion is provided on the first side.

10. An image forming apparatus comprising:

an apparatus body including a positioning portion;

a replaceable member that is provided so as to be attachable to and detachable from the apparatus body, and has a portion to be positioned that comes into contact with and is positioned by the positioning portion at least at one longitudinal end; and an urging mechanism that urges the portion to be positioned toward the positioning portion, wherein the urging mechanism is switched between a state where an urging force acts on the portion to be positioned and a state where an urging force does not act on the portion to be positioned, and wherein, when the position of the replaceable member in a longitudinal direction is determined, the replaceable member is mounted on the apparatus body as the urging mechanism is switched from the state where the urging force of the urging mechanism does not act to the state where the urging force of the urging mechanism acts so that the positioning portion and the portion to be positioned come into contact with each other, the replaceable member has an image carrier, and the portion to be positioned is provided so as to become concentric with a rotating shaft of the image carrier.

11. The image forming apparatus according to claim 10, wherein the positioning portion is a cut-out that is formed in the shape of the letter V in a sheet metal that constitutes the apparatus body.

12. The image forming apparatus according to claim 10, further comprising:

an insertion portion that inserts the replaceable member into the image forming apparatus body; and a guide portion that guides the replaceable member from a first side provided at the insertion portion toward a second side thereof, wherein the positioning portion is provided on the first side.

13. An image forming apparatus comprising:

an apparatus body including a positioning portion;

a replaceable member that is provided so as to be attachable to and detachable from the apparatus body, and has a portion to be positioned that comes into contact with and is positioned by the positioning portion at least at one longitudinal end; and an urging mechanism that urges the portion to be positioned toward the positioning portion, wherein the urging mechanism is switched between a state where an urging force acts on the portion to be positioned and a state where an urging force does not act on the portion to be positioned, and wherein, when the position of the replaceable member in a longitudinal direction is determined, the replaceable member is mounted on the apparatus body as the urging mechanism is switched from the state where the urging force of the urging mechanism does not act to the state where the urging force of the urging mechanism acts so that the positioning portion and the portion to be positioned come into contact with each other, and the positioning portion is a cut-out that is formed in the shape of the letter V in a sheet metal that constitutes the apparatus body.

14. The image forming apparatus according to claim 13, further comprising:

an insertion portion that inserts the replaceable member into the image forming apparatus body; and a guide portion that guides the replaceable member from a first side provided at the insertion portion toward a second side thereof, wherein the positioning portion is provided on the first side.

* * * * *